United States Patent [19]

Constance-Hughes

[11] Patent Number: 4,534,344

[45] Date of Patent: Aug. 13, 1985

[54] BREATHING APPARATUS AND FACEMASKS THEREFOR

[75] Inventor: Trevor Constance-Hughes, Abergavenny, Wales

[73] Assignee: Siebe Gorman & Company Limited, United Kingdom

[21] Appl. No.: 578,079

[22] Filed: Feb. 8, 1984

[30] Foreign Application Priority Data

Feb. 16, 1983 [GB] United Kingdom ..... 8304261

[51] Int. Cl.[3] ..... A62B 7/00

[52] U.S. Cl. ..... 128/201.15; 128/201.23; 128/201.25; 128/201.28; 128/205.12

[58] Field of Search ..... 128/201.15, 201.23, 128/201.25, 201.27, 201.28, 202.26, 204.18, 205.12, 204.26, 205.13, 205.17, 205.25, 205.22, 204.25, 206 R, 206.2 V, 206.15

[56] References Cited

U.S. PATENT DOCUMENTS

| | | | |
|---|---|---|---|
| 1,366,392 | 1/1921 | Lamb et al. | 128/201.15 |
| 2,168,695 | 8/1939 | Asari | 128/201.15 |
| 3,680,556 | 8/1972 | Morgan | 128/201.15 |
| 4,276,877 | 7/1981 | Gdulla | 128/204.26 |
| 4,404,969 | 9/1983 | Cresswell et al. | 128/201.23 |

FOREIGN PATENT DOCUMENTS

| | | | |
|---|---|---|---|
| 342444 | 7/1904 | France | 128/205.12 |
| 950150 | 9/1949 | France | 128/205.12 |

*Primary Examiner*—Henry J. Recla

*Attorney, Agent, or Firm*—Kane, Dalsimer, Kane, Sullivan and Kurucz

[57] ABSTRACT

Closed-circuit compressed-oxygen breathing apparatus in which the oxygen supply is used to demist the visor 7 of the facemask 6 or cool the wearer's face before entering an oronasal mask 8 through a one-way valve 13 and mixing with the gas in the breathing circuit.

9 Claims, 4 Drawing Figures

BREATHING APPARATUS AND FACEMASKS THEREFOR

The invention relates to breathing apparatus, and especially to closed-circuit breathing apparatus in which a life-supporting gas mixture is supplied to the user through a facemask and the gases exhaled by the user are purified, enriched with oxygen, and returned to the user for inhalation.

It has been found with such apparatus that the visor of the face-mask sometimes mists up, because it is difficult to keep the humidity of the air in a closed circuit low and because the visor is close to the face of the user, which is often damp with sweat while the apparatus is being worn.

The invention provides a facemask for breathing apparatus, comprising: an outer mask arranged in use to define with the face of the wearer a volume over the eyes of the wearer that is sealed from the external atmosphere; an inner mask arranged in use to define with the face a volume over the mouth and/or nose of the wearer that is sealed both from the interior of the outer mask and from the external atmosphere; first inlet and outlet means to permit a gas to enter the inner mask from the exterior of the facemask and leave the inner mask to the exterior of the facemask; second inlet means to permit a gas to enter the outer mask from the exterior; connectors for gas pipes or tubes provided at the exterior of the facemask, at least one of the connectors being in communication with the first inlet and outlet means and another of the connectors being in communication with the second inlet means; and a one-way valve to permit a gas to flow from the interior of the outer mask to the interior of the inner mask.

In operation in a closed-circuit breathing apparatus, the gas exhaled by the user typically passes from the outlet means to a purifier where carbon dioxide and water vapour are removed from it, is cooled, and is returned to the first inlet means for inhalation by the user. Oxygen must be added to the gas to replace that consumed by the user, but with a facemask according to the invention the oxygen, instead of being added to the gas during the purification and cooling process, can be brought separately to the second inlet means, used for demisting of a visor or the like forming part of the outer mask, and then mixed with the recirculated gas in the inner mask immediately before it is inhaled.

Preferably, the second inlet means is arranged to direct a flow of gas onto the interior of the visor or onto the face of the user.

The connector of the second inlet means is preferably encircled by a generally annular connector for another said tube, the connectors being so arranged that the tubes can be connected to the connectors one inside the other. Where the first inlet and outlet means has separate connectors for inlet and outlet tubes, the connector for the second inlet means is preferably inside the inlet connector for the first inlet and outlet means.

The invention also provides breathing apparatus including a facemask according to the invention, means arranged in use to receive gas exhaled by the user from the outlet means of the facemask, to remove carbon dioxide and water vapour from that gas, and preferably also to cool that gas, and to return that gas to the first inlet means, and means for supplying oxygen to the second inlet means.

The means for removing carbon dioxide and water vapour and cooling the gas may be of any suitable type, including types conventionally used in closed-circuit breathing apparatus. The oxygen supply may be from an oxygen cylinder through a suitable system of reducing and regulating valves, including conventional systems.

Where, as is preferable, the tube connecting the second inlet means to the rest of the apparatus is within a tube connecting the first inlet and outlet means to the rest of the apparatus, those two tubes are advantageously provided at one or both ends with connectors arranged to enable both tubes to be parted and rejoined as a unit.

One form of breathing apparatus constructed in accordance with the invention will now be described by way of example only with reference to the accompanying drawings, in which.

Figure 1:
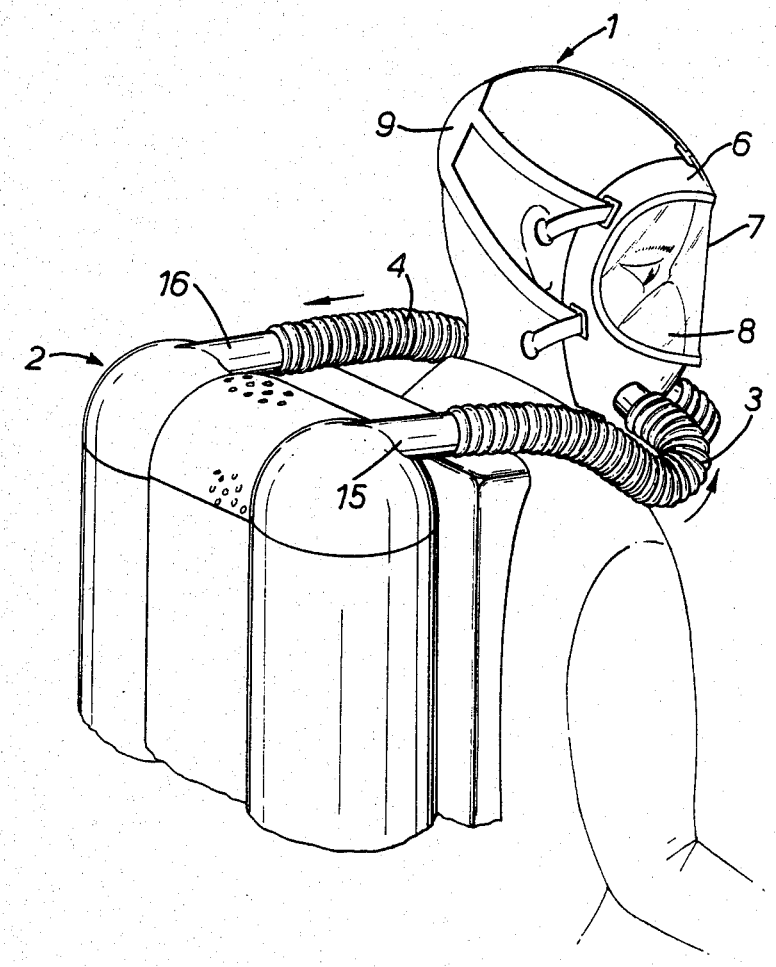
FIG. 1 is a fragmentary perspective view of a person wearing the apparatus.

Referring to the drawings, the apparatus comprises a facemask indicated generally by the reference numeral 1 and a backpack indicated generally by the reference numeral 2 connected by an inspired gas pipe 3 and an expired gas pipe 4. Within the inspired gas pipe 4 runs an oxygen tube 5.

The facemask 1 comprises an outer mask 6 with a visor 7 and an inner oronasal mask 8. In use, the facemask 1 is secured to the head of the wearer by a set of headstraps 9 with the outer rims of both the outer mask 6 and the oronasal mask 8 sealing against the wearer's face. Each of the inspired air pipe 3 and the expired gas pipe 4 is connected by a connector 3*a* or 4*a*, respectively, to an inlet or an outlet, respectively, that passes through the outer mask 6 and opens out into the interior of the oronasal mask 8 through a respective one way valve 10 or 10*a*, the inlet, the outlet, and the one-way valves forming first inlet and outlet means for the oronasal mask 8.

The oxygen tube 5 is connected by a connector 5*a* to a duct 11 that passes through the side of the inspired gas inlet between the connector 3*a* and the one-way valve 10, between the outer mask 6 and the oronasal mask 8. The duct 11 then passes up the outer mask 6, skirting the visor 7, and along the top of the visor. Along the top of the visor 7, the duct 11 has shaped apertures 12 in it to direct the oxygen that in operation is supplied through the tube 5 down over the inside of the visor to demist the visor, or over the face of the wearer to cool that, or both. The oxygen can then flow through a one way valve 13 into the oronasal mask to be breathed by the wearer.

Figure 2:
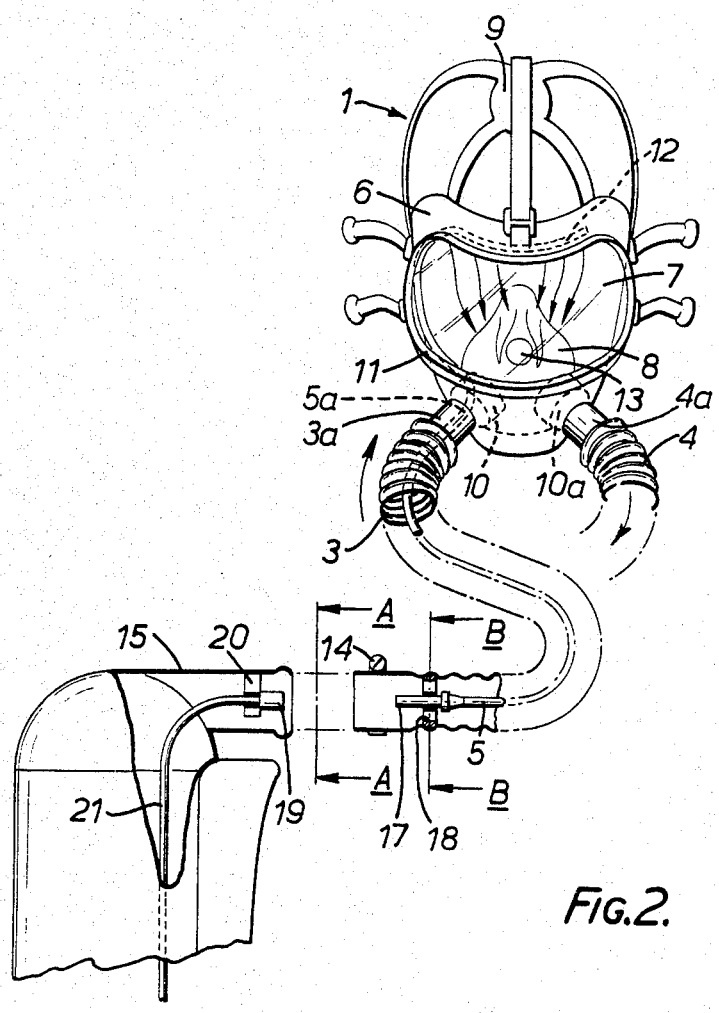
FIG. 2 is a fragmentaty perspective view of the apparatus, partly cut-away.
Figure 3:
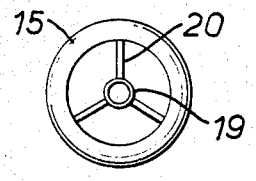
FIG. 3 is a view on the line A—A of FIG. 2.
Figure 4:
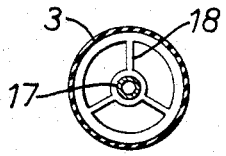
FIG. 4 is a section on the line B—B of FIG. 2.

The inspired gas pipe 3 and the expired gas pipe 4 are of conventional construction in the form of pleated flexible tubes; the much narrower oxygen tube 5 may be smooth walled without significantly hindering movement of the wearer's head. The pipes 3 and 4 are secured by clips 14 to stub pipes 15 and 16, respectively, on the backpack 2. As may be seen from FIG. 2, the oxygen tube 5 terminates in a connector 17 supported by a spider 18 in the centre of the end portion of the inspired gas pipe 3. A corresponding connector 19 is mounted on a spider 20 in the stub pipe 15, the arrangement being such that when the inspired gas pipe 3 is slid onto the stub pipe 15 the connectors 17 and 19 almost automatically mate and seal, but they can equally easily be separated, for example, for maintenance, and rejoined. The connectors 3*a* and 5*a* may be arranged in that way as well as, or instead of, the connectors 17 and 19.

The connector 19 is on the end of an oxygen supply pipe 21 in the backpack 2, with which the oxygen tube 5 communicates with the connectors 17 and 19 are mated. The oxygen supply pipe 21 is connected to an oxygen cylinder (not shown) through reducing and regulating valvework (not shown). The expired gas stub pipe 16 communicates with the inlet side of a conventional gas purifier (not shown) arranged to remove excess carbon dioxide and water vapour from the breathing gas by chemical reactions, for example, with calcium oxide and sodium hydroxide; the outlet side of the purifier is connected to the inlet side of a cooler (not shown) for the gas, which may also be of conventional type; the outlet side of the gas cooler is connected to a breathing bag (not shown) to accommodate changes in the volume of gas in the user's lungs and maintain the total gas volume of the breathing circuit substantially constant; and the breathing bag is connected to the inspired gas stub pipe 15.

What I claim is:

1. A facemask for breathing apparatus, comprising: an outer mask arranged in use to define with the face of a wearer a volume over the eyes of the wearer that is sealed from the external atmosphere; an inner mask arranged in use to define with the face of the wearer a volume over the mouth and/or nose of the wearer that is sealed both from the interior of the outer mask and from the external atmosphere; first inlet and outlet means to permit a gas to enter the inner mask from the exterior of the facemask and leave the inner mask to the exterior of the facemask; second inlet means to permit a gas to enter the outer mask from the exterior; connectors for gas pipes or tubes provided at the exterior of the facemask, at least one of the connectors being in communication with the first inlet and outlet means and another of the connectors being in communication with the second inlet means; and a one-way valve to permit a gas to flow from the interior of the outer mask to the interior of the inner mask.

2. A facemask as claimed in claim 1, wherein a connector for the first inlet and outlet means is of generally annular form and the connector for the second inlet means is encircled by the said annular connector for the first inlet and outlet means.

3. A facemask as claimed in claim 2, wherein there are provided at least two of the said connectors for the first inlet and outlet means, and the first inlet and outlet means is arranged in operation to permit a gas to enter the inner mask through the said annular connector and leave the inner mask through another said connector.

4. A facemask as claimed in claim 1 wherein the outer mask includes a transparent portion through which in use the wearer sees and the second inlet means is arranged in operation to direct a current of gas over the inner surface of that transparent portion of the outer mask.

5. A facemask as claimed in claim 4, wherein the gas enters the interior of the outer mask from the second inlet means through one or more apertures along the top edge of the said transparent portion.

6. A facemask as claimed in claim 1, wherein the second inlet means is arranged in operation to direct a current of gas onto the face of the wearer.

7. Breathing apparatus comprising a facemask as claimed in claim 1, means connected to said inlet and outlet means for purifying gas from the first inlet and outlet means and supplying the purified gas to the first inlet and outlet means, and means adapted to supply oxygen to the second inlet means.

8. Breathing apparatus as claimed in claim 7, which comprises a backpack unit including means arranged to be worn as a backpack by the wearer and having the purifying means and said means adapted to supply oxygen therein; and flexible pipe means connected between said one connector of the facemask and said purifying means through which in operation exhaled gas flows from the inner mask to the purifying means and purified gas flows to the inner mask from the purifying means and between said another connector and said means adapted to supply oxygen through which in operation oxygen gas flows to the interior of the outer mask.

9. Breathing apparatus as claimed in claim 8, wherein the facemask is as claimed in claim 2 and said flexible pipe means for supplying oxygen to the second inlet means is within the said flexible pipe means for supplying the purified gas to the first inlet means.

* * * * *